US009126086B2

(12) United States Patent
Howard, II

(10) Patent No.: US 9,126,086 B2
(45) Date of Patent: Sep. 8, 2015

(54) SPORTS TRAINING SYSTEM AND METHOD

(76) Inventor: Hershel James Howard, II, Houston, TX (US)

( * ) Notice: Subject to any disclaimer, the term of this patent is extended or adjusted under 35 U.S.C. 154(b) by 12 days.

(21) Appl. No.: 13/226,938

(22) Filed: Sep. 7, 2011

(65) Prior Publication Data

US 2012/0071279 A1 Mar. 22, 2012

Related U.S. Application Data

(60) Provisional application No. 61/383,935, filed on Sep. 17, 2010.

(51) Int. Cl.

| | |
|---|---|
| ***A63B 69/00*** | (2006.01) |
| *A63B 47/00* | (2006.01) |
| *A63B 69/36* | (2006.01) |
| *A63B 71/00* | (2006.01) |

(52) U.S. Cl.

CPC ..... *A63B 69/0002* (2013.01); *A63B 47/00* (2013.01); *A63B 69/3667* (2013.01); *A63B 71/0045* (2013.01); *A63B 2069/0006* (2013.01); *A63B 2069/0008* (2013.01); *A63B 2209/08* (2013.01); *A63B 2210/50* (2013.01); *A63B 2243/0004* (2013.01); *A63B 2243/0008* (2013.01); *Y10T 29/49826* (2015.01)

(58) Field of Classification Search

CPC ..... A63B 2069/0002; A63B 2069/0006; A63B 2069/0008; A63B 69/00; A63B 69/0002; A63B 57/0018

USPC ..... 473/417, 422, 451, 452; D21/717–719, D21/780; 434/247

See application file for complete search history.

(56) References Cited

U.S. PATENT DOCUMENTS

| | | | | | |
|---|---|---|---|---|---|
| 2,527,906 | A | * | 10/1950 | Bennett et al. | 473/417 |
| 2,884,250 | A | * | 4/1959 | Patterson | 473/423 |
| 3,195,266 | A | * | 7/1965 | Onanian | 446/86 |
| 3,374,197 | A | * | 3/1968 | England et al. | 524/522 |
| 3,374,917 | A | * | 3/1968 | Troy | 206/504 |
| 4,392,323 | A | * | 7/1983 | Rubik | 403/96 |
| 4,551,110 | A | * | 11/1985 | Selvage et al. | 403/348 |
| 4,886,267 | A | * | 12/1989 | Licciardi et al. | 473/417 |

(Continued)

OTHER PUBLICATIONS

"Pro Stance", Baseball Softball Training Aid, [retrieved from the Internet Sep. 9, 2010 using <URL: http://cgi.ebay.com/ws/eBayISAPI.dllViewItem&item=320501583197&rvr_id=136213441747&crlp=1_263602_263622&UA=WXI7&GUID=a0fa153e12a0a06459a59895ffd2a34d&itemid=320501583197&ff4=263602_263622>].

(Continued)

*Primary Examiner* — Mitra Aryanpour
(74) *Attorney, Agent, or Firm* — Gardere Wynne Sewell LLP

(57) ABSTRACT

The disclosure provides a modular sports training system that can be assembled, placed on a supporting surface, and stood upon by a person during sports training activities. The system is adapted to be assembled with one module being disposed at a non-parallel angle to another module. The non-parallel angle allows a person standing on the system to place one foot on one module and another foot on another module at the non-parallel angle, such as in a batter's stance, and allows the person to stand in a stable manner while encouraging certain positioning of the feet during the sports training activities. The modules can be coupled by an interlocking protrusion and receiver arrangement. The modules can be coupled together by inserting a protrusion of one module into a receiver of another module when the modules are unaligned relative to each other; and then twisting the modules into alignment.

32 Claims, 7 Drawing Sheets

(56) References Cited

U.S. PATENT DOCUMENTS

| | | | | |
|---|---|---|---|---|
| 4,932,916 | A * | 6/1990 | Blickle | 446/124 |
| 5,000,713 | A * | 3/1991 | Cheng | 446/120 |
| 5,106,085 | A * | 4/1992 | Lewy | 473/417 |
| 5,186,672 | A * | 2/1993 | Tung | 446/95 |
| 5,322,276 | A * | 6/1994 | Hardison, Jr. | 473/417 |
| 5,389,054 | A * | 2/1995 | Dorman | 482/34 |
| 5,626,435 | A * | 5/1997 | Wohlhuter | 403/348 |
| D411,864 | S * | 7/1999 | Krog | D21/502 |
| 6,254,303 | B1 * | 7/2001 | Falat et al. | 403/348 |
| 6,302,617 | B1 * | 10/2001 | Rumpp | 403/348 |
| D460,507 | S * | 7/2002 | Stewart | D21/688 |
| 6,506,091 | B1 * | 1/2003 | Garpow | 446/75 |
| 6,595,825 | B1 * | 7/2003 | De Wilde | 446/102 |
| D514,638 | S * | 2/2006 | deGrasse | D21/717 |
| 7,347,028 | B1 * | 3/2008 | Bin-Nun et al. | 52/271 |
| 7,644,828 | B1 * | 1/2010 | Klein | 220/23.4 |
| 7,882,674 | B2 * | 2/2011 | Craven et al. | 52/606 |
| D674,032 | S * | 1/2013 | Howard, II | D21/698 |
| 8,403,723 | B1 * | 3/2013 | Haner | 446/120 |
| 8,888,552 | B2 * | 11/2014 | Wizenberg et al. | 446/102 |
| 2002/0115374 | A1 * | 8/2002 | Lavender | 446/85 |
| 2005/0191932 | A1 * | 9/2005 | Lin | 446/85 |
| 2009/0305824 | A1 * | 12/2009 | Sanders | 473/417 |

OTHER PUBLICATIONS

"Batters Edge Base & Softball Balance Beam",Texas Rip-It Sports, [retrieved from the Internet Jul. 29, 2010 using <URL: http://www.texasripitsports.com/baedbabe.html>].

"Baseballance", [retrieved from the Internet Nov. 22, 2010 using <URL: http://www.baseballance.com/>].

"The FIX", [retrieved from the Internet Jul. 29, 2010 using <URL: http://store.statsintl.com/shop/pc/viewPrd.asp?idproduct=4&idcategory=2>].

* cited by examiner

SPORTS TRAINING SYSTEM AND METHOD

CROSS REFERENCE TO RELATED APPLICATIONS

This application claims the benefit of U.S. Provisional Application No. 61/383,935, filed Sep. 17, 2010.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention relates generally to the field of sports. More specifically, it relates to a system and method of training persons for sports activities, such as batting and throwing.

2. Description of the Related Art

Sports training devices are generally designed for strength, agility, and coordination of motor skills. The devices can be complicated or simple, with even simple devices sometimes filling an unmet need.

In baseball or softball, for example, a proper batting stance is important for training, especially in the formative years of a batter. Generally, the feet are spaced at a shoulder distance and transverse to the direction of an oncoming ball with knees slightly bent and body weight slightly weighted to the back leg. Upon the ball approaching, the batter smoothly steps in with a front foot in a direction parallel to an imaginary line from the ball to the pitcher leaving the back foot in position. One of the common mistakes for batters is to step away or "outside" from the imaginary line, which can cause the batter to swing outside the ball path and miss the ball. The batter may also step inside toward the imaginary line and "crowd" that ball, resulting in a poorly hit ball by hitting the ball with a portion of the bat that is inside the "sweet spot" of the bat. Thus, one aspect of training is to encourage and ingrain proper stepping techniques during the swing.

Other training techniques include proper pitching techniques from a mound. A pitcher typically steps on a "pitching rubber" with a back foot and throws the ball while the front foot steps forward toward the batter at the home plate. However, the height of a pitching mound for the stationary back foot to the height of the ground where the stepping front foot lands can differ by several inches. An inexperienced pitcher can loose balance, and therefore control and speed, during the process with the several inches of elevation difference from mound to ground. A suitable pitching training device can assist in developing the balance and skill needed.

One training device is a "T" shaped wooden arrangement made from two (2) wooden pieces attached together with "L" brackets and screws. The wooden device can be laid on the ground and the batter can stand on the wooden arrangement. A back foot stands on the short length of the "T" and the front foot stands on the long length of the "T."

Commercially available training devices include "The Baseballance," "The Batter's Edge Balance Beam," "The Fix," and the "ProStance" balance aid.

While the benefits of training devices are known, none of the above examples meet the market needs in a totally satisfactory manner. For example, the above "T" wooden arrangement is heavy, and because it is screwed together, does not easily break into separate pieces. If not taken apart, the device will not fit in a passenger car and requires a large SUV or pick-up truck, should a person desire to transport this wooden arrangement. The above Baseballance device is not stable as a supporting surface with its rocking function. The Batter's Edge Balance Beam and the Pro Stance training aid devices are straight beams. The Fix device appears directed to keeping one foot stationary without affecting both feet.

There remains a need for an improved, lightweight, variable length, portable sports training assembly that can be easily assembled and disassembled.

BRIEF SUMMARY OF THE INVENTION

The disclosure provides a modular sports training system adapted to be assembled, placed on a supporting surface, and stood upon by a person during sports training activities. The system is adapted to be assembled with one module being disposed at a non-parallel angle to another module. The non-parallel angle allows a person standing on the system to place one foot on one module and another foot on another module at the non-parallel angle, such as in a baseball or softball batter's stance, and allows the person to stand in a stable manner while encouraging certain positioning of the feet during the sports training activities. The modules can be coupled by an interlocking protrusion and receiver arrangement. The modules can be coupled together by inserting a protrusion of one module into a receiver of another module, when the modules are unaligned relative to each other; and then twisting the modules into alignment.

The disclosure provides a sports training assembly, comprising: a first module comprising: a formed structure having at least a top, a first and second end formed at a non-parallel angle to the top, and at least one side formed at a non-parallel angle to the top and the ends; a protrusion coupled to the first end; a receiver formed in the second end; a receiver or protrusion formed in at least the one side; the top being adapted to allow a person to stand on; and a second module interchangeable with the first module having the protrusion and receivers, and adapted to be coupled from an end of the second module to the side of the first module at a non-parallel angle to the first module to extend therefrom.

The disclosure also provides a method of assembling a sports training assembly for sports activities, comprising: obtaining a first module comprising: a formed structure having at least a top, a first and second end formed at a non-parallel angle to the top, and at least one side formed at a non-parallel angle to the top and the ends; a protrusion coupled to the first end; a receiver formed in the second end; a receiver or protrusion formed in at least the one side; and further provides obtaining a second module interchangeable with the first module having the protrusion and receivers, inserting the protrusion of one module into a receiver of another module when the modules are at a rotated angle relative to each other and the tops of the modules are non-aligned; and twisting rotationally at least one of the modules relative to the other module to align the tops of the modules and to restrict the protrusion from exiting the receiver.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art how to make and use the invention for which patent protection is sought. Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the invention disclosed and taught herein is susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The disclosure provides a modular sports training system adapted to be assembled, placed on a supporting surface, and stood upon by a person during sports training activities. The system is adapted to be assembled with one module being disposed at a non-parallel angle to another module. The non-parallel angle allows a person standing on the system to place one foot on one module and another foot on another module at the non-parallel angle, such as in a batter's stance, and allows the person to stand in a stable manner while encouraging certain positioning of the feet during the sports training activities. The modules can be coupled by an interlocking protrusion and receiver arrangement. The modules can be coupled together by inserting a protrusion of one module into a receiver of another module when the modules are unaligned relative to each other; and then twisting the modules into alignment.

Figure 1:
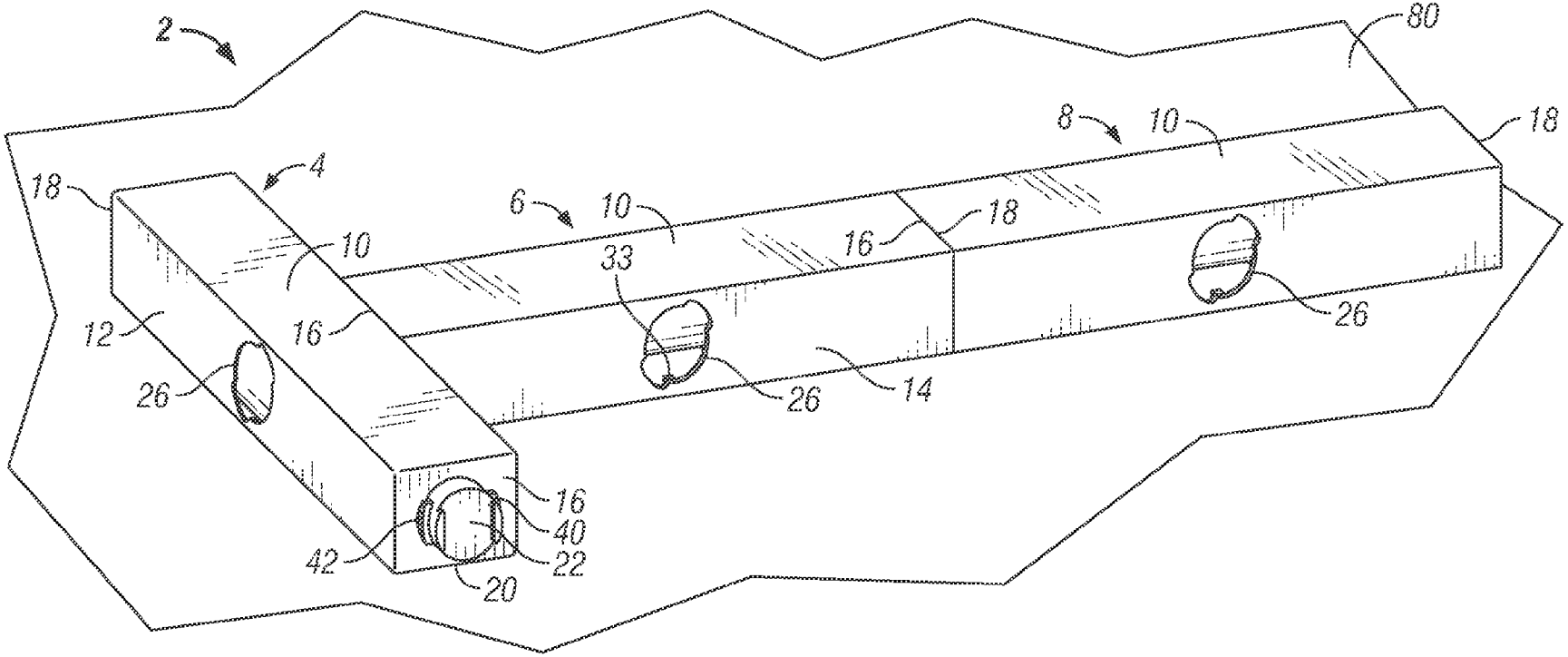
FIG. 1 is a perspective schematic view of an exemplary embodiment of a modular sports training assembly having a plurality of assembled modules.
Figure 2:
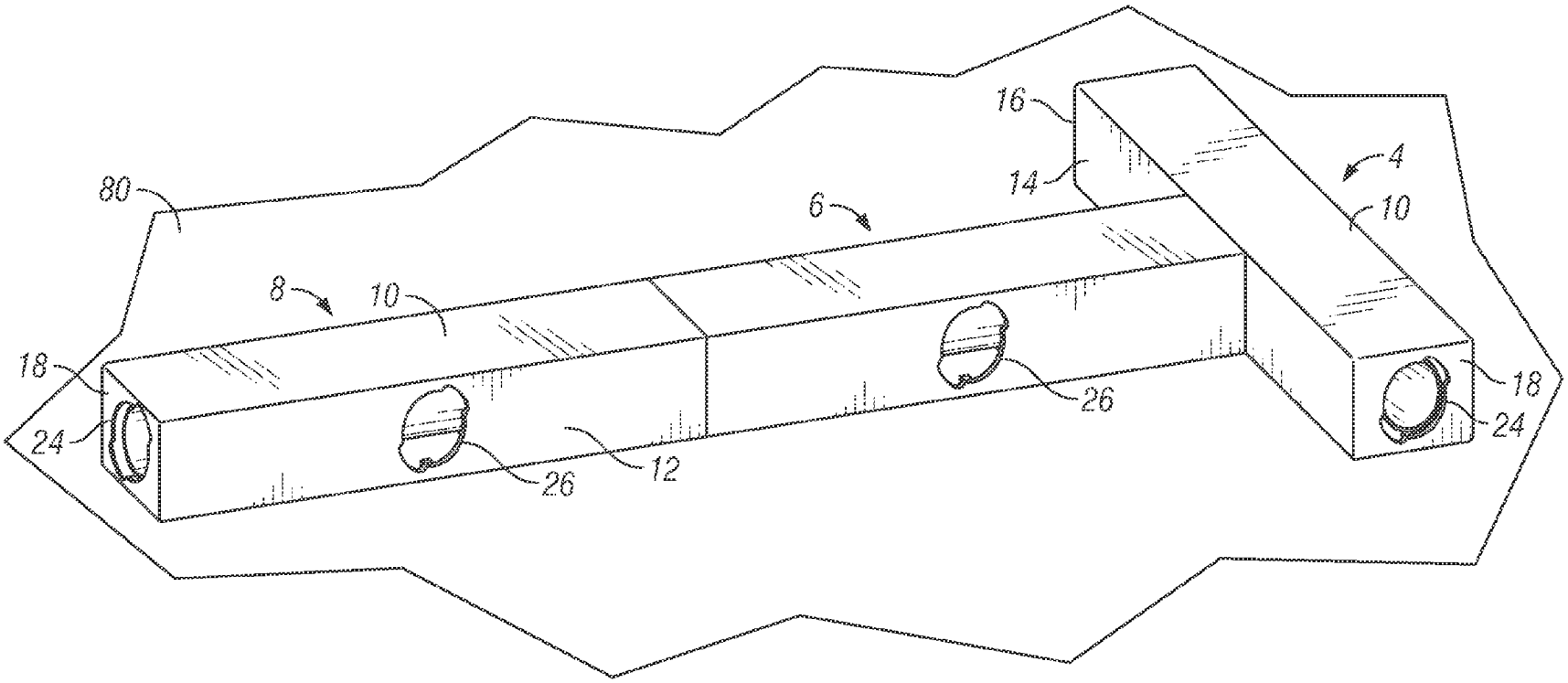
FIG. 2 is a perspective schematic view of the exemplary modular sports training assembly of FIG. 1 with the plurality of assembled modules viewed from an opposite side.
Figure 3:
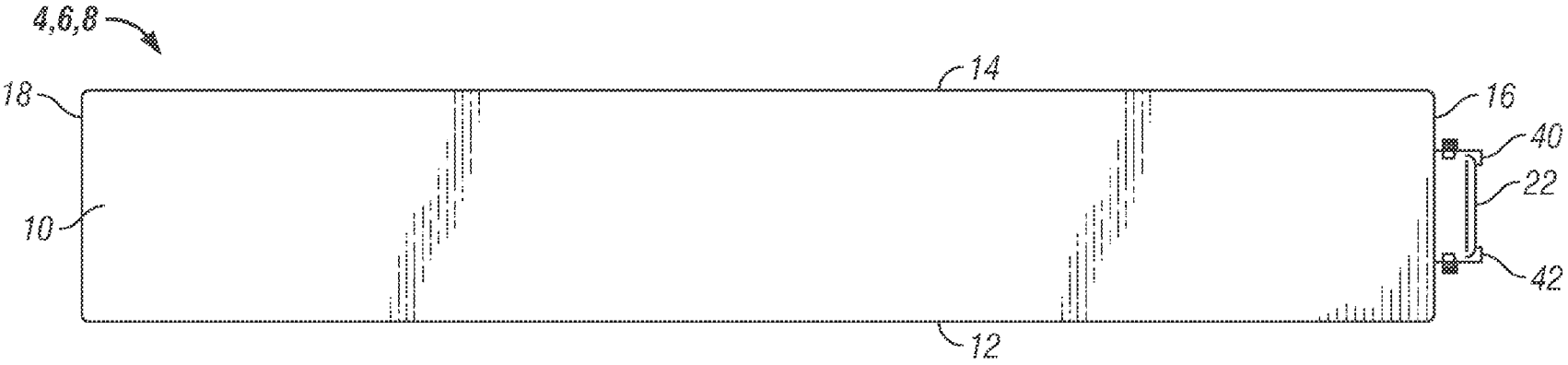
FIG. 3 is a top schematic view of an exemplary module of the modular sports training assembly.
Figure 4:
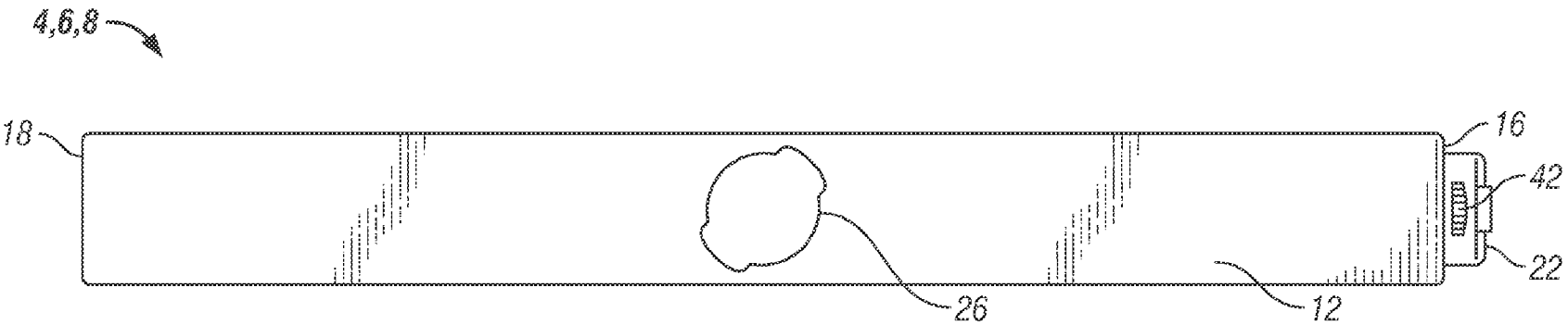
FIG. 4 is a side schematic view of the exemplary module.

FIG. 1 is a perspective schematic view of an exemplary embodiment of a modular sports training assembly having a plurality of assembled modules. FIG. 2 is a perspective schematic view of the exemplary modular sports training assembly of FIG. 1 with the plurality of assembled modules viewed from an opposite side. FIG. 3 is a top schematic view of an exemplary module of the modular sports training assembly. FIG. 4 is a side schematic view of the exemplary module. The figures will be described in conjunction with each other.

The sports training assembly 2 includes at least two modules and generally three or more modules. In at least one embodiment, each module can be interchangeable with the other modules, so that each module can be coupled to another module in like manner. In the exemplary embodiment shown in FIG. 1, a first module 4 can be coupled to a second module 6. The second module 6 can in turn be coupled to a third module 8. The order of the modules can vary, because the modules are interchangeable. In the exemplary embodiment, the first module 4 is coupled crossways or lateral to the second module 6, and is therefore non-parallel to the second module 6. Any suitable non-parallel angle can be used, and in the exemplary embodiment, the modules are at right angles. The third module 8 can be coupled parallel to the second module, 6, so that it is aligned with the second module 6. As will be detailed further herein, the modules have various receivers and protrusions to allow the coupling and interchangeability described herein. The modules generally have a top 10, a first side 12, and a second side 14. The sides are at non-parallel angles to the top 10. Further, the modules have a first end 16, and a second end 18 at non-parallel angles to the sides 12, 14, and the top 10. Further, the modules generally have a bottom 20 for use in supporting the modules on a surface, such as the ground. For example without limitation, the sides can be approximately four (4) inches tall, the top can be approximately six (6) inches wide, and the length along the side can be approximately 36 inches long, including the length of the protrusion. It has been found that a dimension of six (6) inches for the width is approximately wide enough for a person to stand crossways in a transverse manner to the top and still have sufficient support. The length of 36 inches has been found to be advantageous for storing bats and various items in the tube 78 described in FIG. 10. Naturally, other dimensions and proportions can be used and such examples are only offered as non-limiting illustrations.

The modules further include a protrusion 22 disposed on the first end 16, and a receiver 24 disposed on the second end 18, opposite from the first end 16. Further, the modules have a receiver 26 on at least one of the sides 12, 14, and generally on both sides in the exemplary embodiment. As an alternative embodiment, the receivers on the side of the modules can be located at positions other than shown, including toward one end or another, and further can include multiple receivers on the sides or other surfaces. The protrusion 22 can include a first protrusion wing 40 and a second protrusion wing 42. The receivers 24, 26 can include a receiver tab 33. The protrusion 22 of one module is sized and shaped to fit within one or more of the receivers 24, 26 of another module. The protrusion 22 is adapted to be rotated to a desired angular position within the receiver 24, 26, so that the wings 40, 42 are restrained within the module walls adjacent the receiver to couple the modules together, and the wings are restricted from further rotation by the receiver tab 33.

Figure 5:
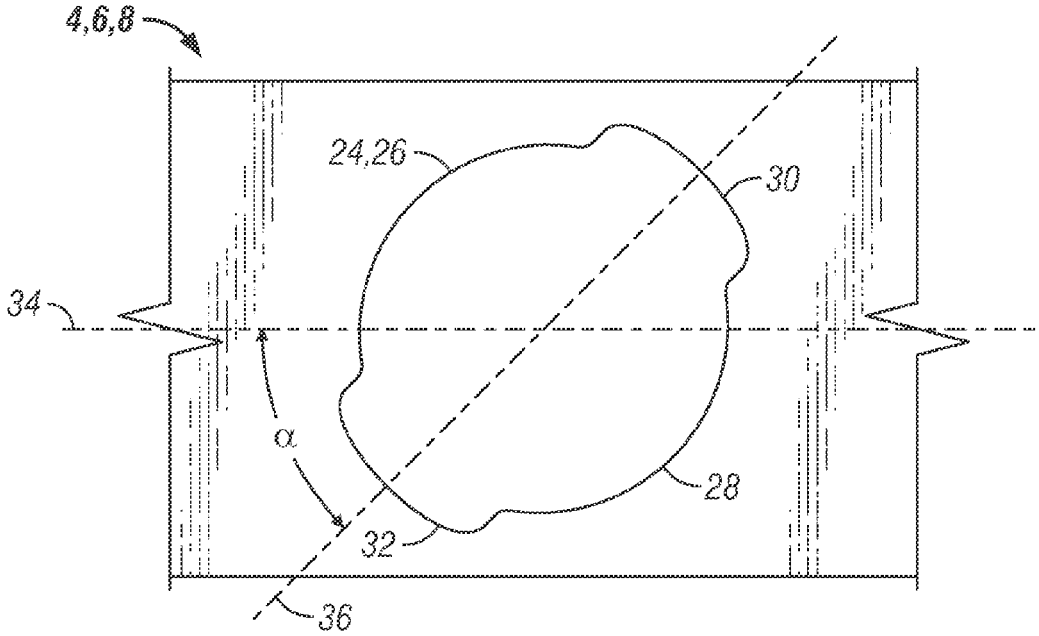
FIG. 5 is a detail perspective schematic view of an exemplary receiver of the module.

FIG. 5 is a detail perspective schematic view of an exemplary receiver of the module. The receivers 24, 26 are generally formed through a wall of the modules, such as module 4. The receivers 24, 26 can have a variety of shapes. In at least one embodiment, the receivers 24, 26 can include a main receiver portion 28 and a first receiver extension 30. In some embodiments, the receivers 24, 26 can also include a second receiver extension 32. In general, the receivers 24, 26 will have a shape that allows the protrusion 22, described herein, to be inserted and restrained therein. Thus, generally the main receiver portion 28 will have a contour periphery that is closer to a center of the receiver than the distance that a contour periphery of the receiver extension is to the receiver center. The exemplary receivers 24, 26 illustrate two receiver extensions, but the number of receiver extensions can vary from one to many.

Further, the receivers 24, 26 in a module can be tilted or rotated relative to a datum plane for assembly or disassembly with a corresponding protrusion of an adjacent module. For example, a datum plane 34 can be defined as a horizontal plane passing through a center of the receiver when the module top 10, shown in FIGS. 1 and 2, is horizontal. A positional angle "$\alpha$" of a receiver extension 30 relative to the plane 34 can be defined from the plane to a line 36 drawn through a center of the receiver extension and the center of the receiver. The receivers 24, 26, and the module associated with that particular receiver, can be rotated from a first orientation relative to the datum plane 34 to a second orientation, thus changing the angle "$\alpha$". The rotated receiver can be aligned and coupled to an adjoining protrusion at the rotated orientation and then rotated to a different orientation, including returning to the first orientation, to couple the receiver and protrusion together, such as in a locking engagement. A receiver tab, described herein, can be formed inside of the receivers 24, 26 to limit the rotation of the protrusion 22 in the receiver. Alternatively, the receiver tab can be formed outside of the receiver area on the module external surfaces or other suitable locations to restrict the rotation of the protrusion. The above example illustrates the rotation of the receiver and is equally applicable to the rotation of the protrusion to be coupled to the receiver, or the rotation of both the receiver and protrusion to assist in coupling the receiver and the protrusion together.

Figure 6:
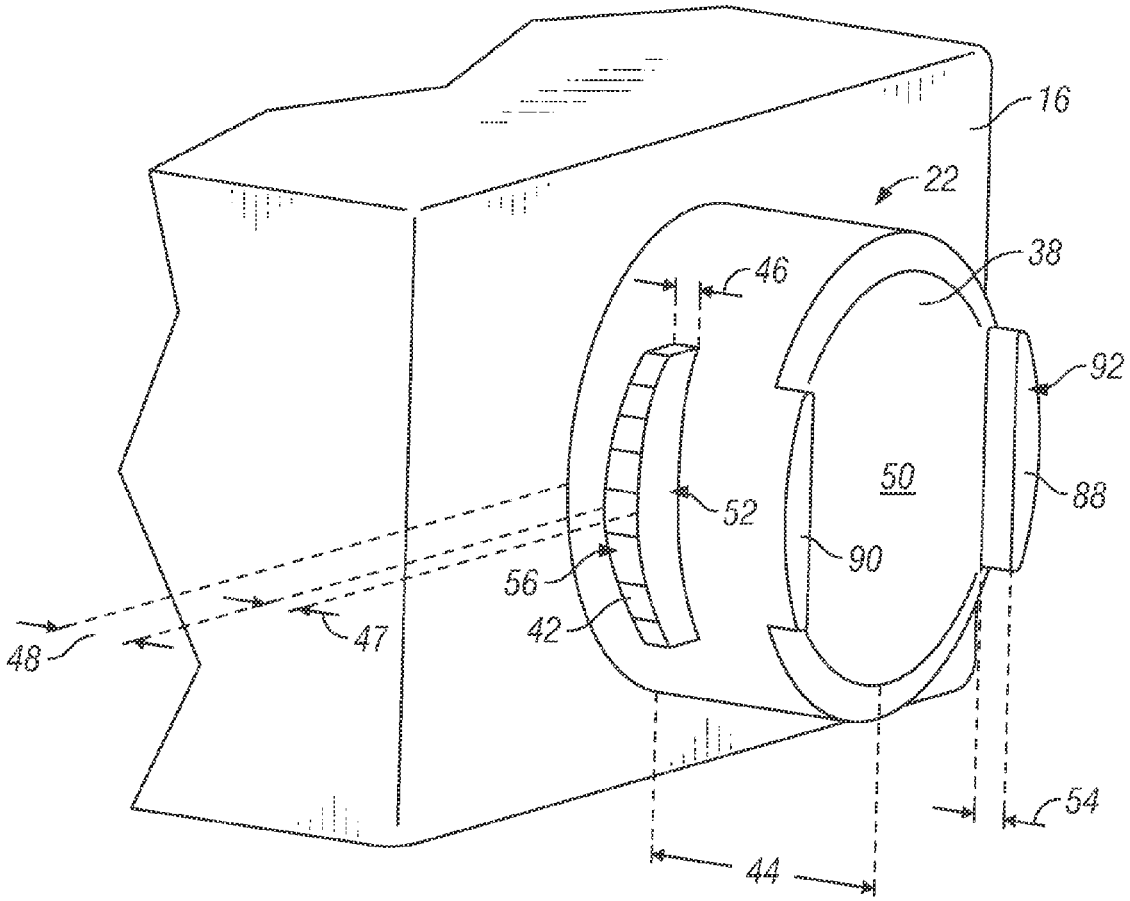
FIG. 6 is a detail perspective schematic view of an exemplary protrusion of the module.
Figure 7:
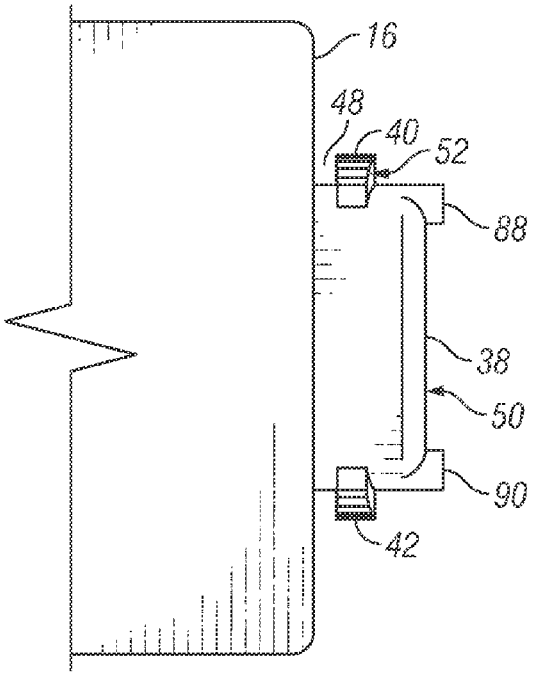
FIG. 7 is a detail top schematic view of the protrusion of FIG. 6.
Figure 8:
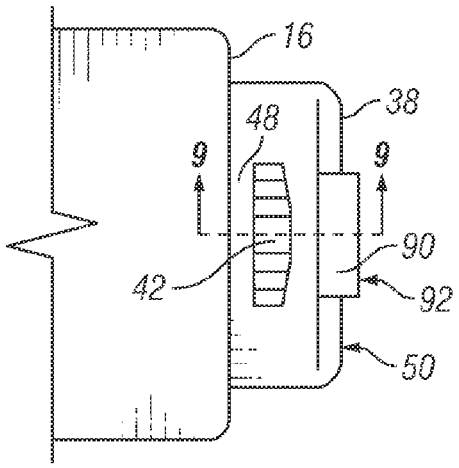
FIG. 8 is a detail side schematic view of the protrusion of FIG. 6.
Figure 9:
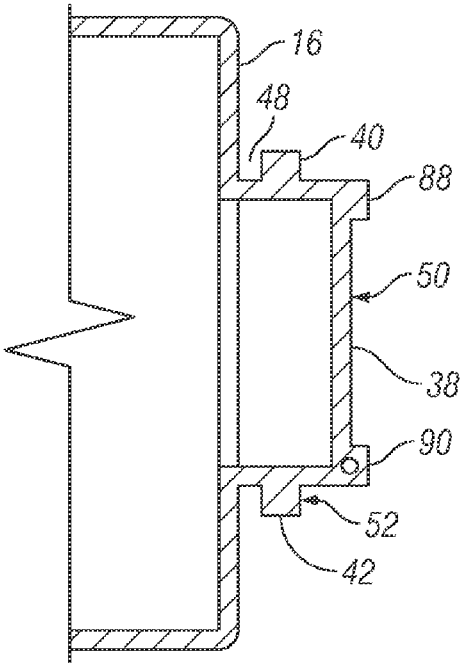
FIG. 9 is a detail partial cross sectional schematic view of the protrusion of FIG. 6.

FIG. 6 is a detail perspective schematic view of an exemplary protrusion of the module. FIG. 7 is a detail top schematic view of the protrusion of FIG. 6. FIG. 8 is a detail side schematic view of the protrusion of FIG. 6. FIG. 9 is a detail partial cross sectional schematic view of the protrusion of FIG. 6. The figures will be described in conjunction with each other. The particular arrangement and profile of the exemplary protrusion 22 is designed to fit within the receiver 24, described in FIG. 5. However, it is understood that different variations including non-symmetrical, offset, and other variations are possible for the shape of the protrusion 22.

The exemplary protrusion 22 includes a main protrusion portion 38 that is coupled to the first end 16 of an exemplary module. The main protrusion portion 38 extends in a direction outwardly from the first end 16 for a thickness 44, and has an outer surface 50 disposed distally from the first end. A first wing 40 and a second wing 42 extend radially from the main protrusion portion 38. A peripheral surface 56 of the wings is generally shaped to allow insertion of the protrusion 22 into the receivers 24, 26, and particularly into the receiver extensions 30, 32. The wings 40, 42 are spaced longitudinally outward from the end 16 by a gap 48. The wings can have a first wing thickness 46 at an edge of the wing that enlarges to a thicker second wing thickness 47 with an outer surface 52 disposed distally from the module end 16. The varying thickness allows the wings 40, 42 to tighten the coupling engagement between adjacent modules as the wings are rotated relative to the receivers 24, 26, so that the outer surface 52 of the wings engages a module inner wall surface adjacent the receivers 24, 26.

In at least one embodiment, a first protrusion tab 88 and a second protrusion tab 90 with an outer surface 92 extend longitudinally outward from the main protrusion portion 38. Thus, the protrusion tabs 88, 90 relative to the main protrusion portion 38 form a recess having a depth 54 between the outer surface 50 of the main protrusion portion 38 and the outer surface 92 of the protrusion tabs 88, 90. This recess is used to help couple the modules together during transportation, as shown in FIG. 11.

Figure 10:
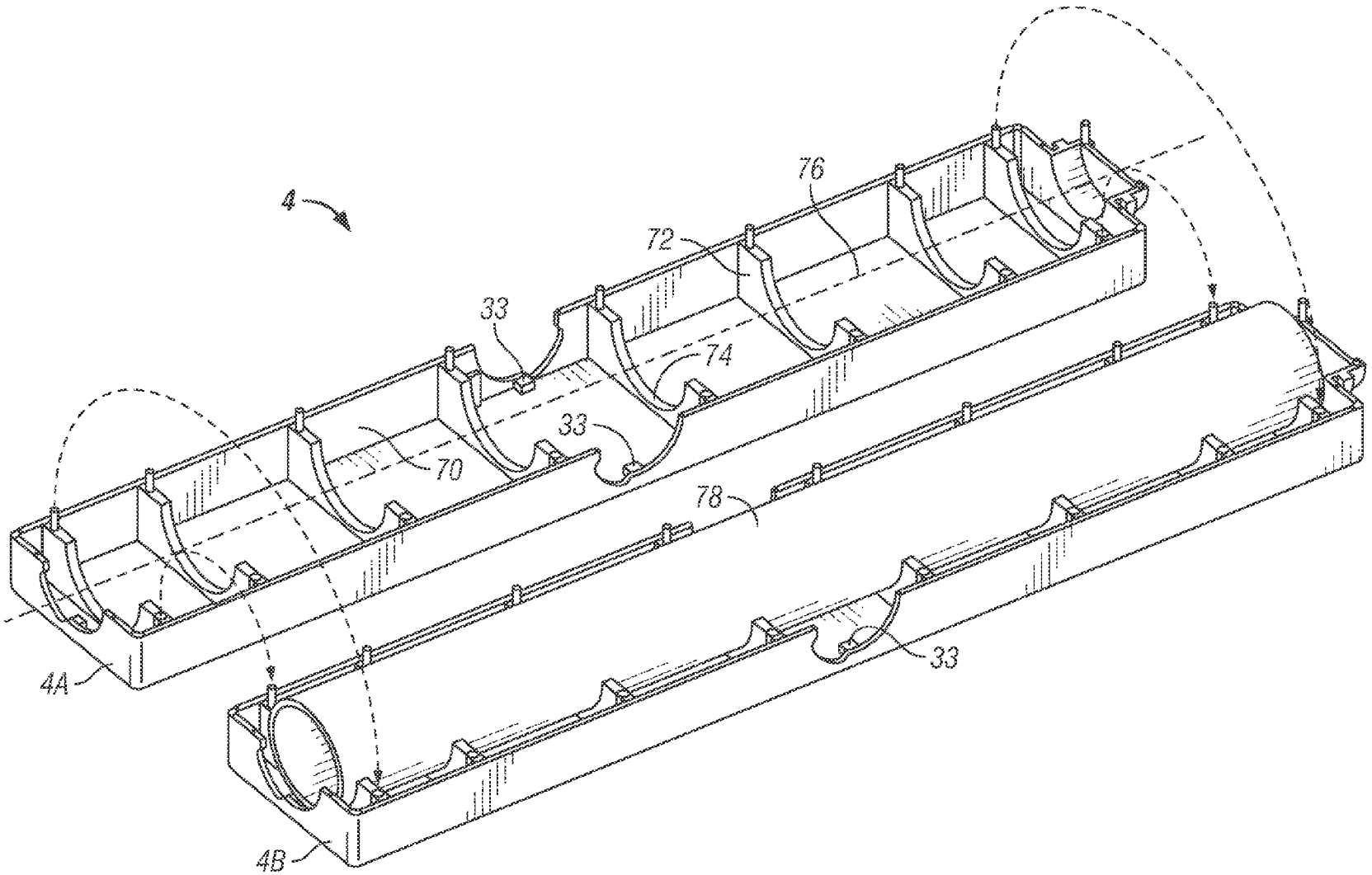
FIG. 10 is a perspective schematic view of an exemplary disassembled module.

FIG. 10 is a perspective schematic view of an exemplary disassembled module. In at least one embodiment, the modules, such as module 4, can be formed in multiple portions and coupled thereto. For example, the module 4 can be formed from a first portion 4A and a second portion 4B that can be adhesively connected together or otherwise fastened together. The module portion 4A can be formed with an outer wall 70 that can be coupled to a corresponding outer wall on the other module portion 4B. In some embodiments, the outer wall 70 may include various locators, ridges, valleys, and other items that may assist in proper alignment and coupling of the two module portions. Additionally, screws and other fasteners can be used to retain the module portions together, such as by tightening a screw or other fastener through a thin tube with a shoulder (in place of a pin locator) on one module portion into a corresponding hole on the other module portion, as customarily is done by those in the art. The fasteners may be particularly useful while any applied adhesive cures between the module portions. The protrusions and receivers described above can be formed as portions in each module portion. Each portion of a receiver can include one or more protrusion tabs 33. Further, the module portions 4A, 4B can include braces 72 disposed at various locations along a length of the module portions. In at least one embodiment, the brace 72 can be formed with a cavity 74, so that a series of braces forms a series of cavities along a longitudinal axis 76 of the module portions. The opening 74 can be sized to allow a tube 78 to be disposed therein. Thus, when the module portions 4A, 4B are coupled, the tube 78 is encased and secured between the module portions and thus within the module 4. The term "tube" is used broadly herein to include any shaped hollow member, including those members having a cross section that is round, elliptical, square, rectangular, and other geometric or arbitrary shapes, and further can vary in shape and size along the longitudinal axis 76. In at least one embodiment, the tube 78 allows a bat to be disposed and stored therein during transportation of the sports training assembly to a sports location. Further, the tube can be used to store beverages and other refreshments, balls, and other items that fit therein. It has generally been found that a tubular inside cross-sectional dimension of three (3) inches is suitable for storing baseballs, bats, cans, and bottled beverages.

Figure 11:
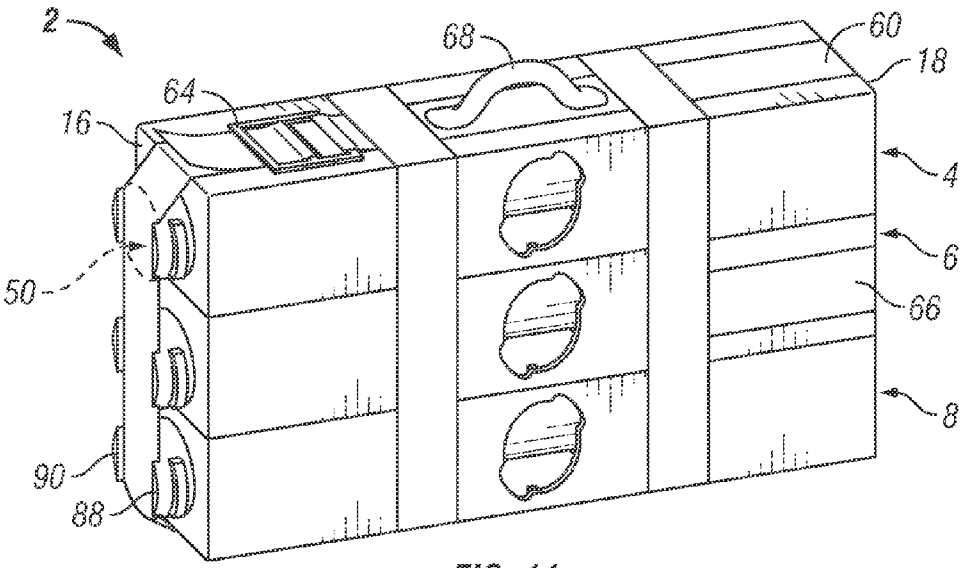
FIG. 11 is a perspective schematic view of the plurality of modules of the exemplary modular sports training assembly ready for transportation to a sports training location.

FIG. 11 is a perspective schematic view of the plurality of modules of the exemplary modular sports training assembly ready for transportation to a sports training location. The sports training assembly 2 can advantageously be disassembled and assembled for ease of transportation to sports training locations. In one embodiment, the modularity of the assembly allows ease of stacking and storage. For example, the three illustrated modules 4, 6, 8 can be stacked and held in place by a carrying strap 60. The strap 60 can align on the first end 16 and pass over the recessed outer surface 50 between the first and second protrusion tabs 88, 90 on each of the modules. A strap saddle 66 around one or more ends 18 can be used to hold the strap 60 in position. A latch 64 can be used to tighten the strap around the modules and secure the modules in position. A carrying handle 68 can be included with the strap. Other carrying cases can be provided, such as a duffle bag style case that substantially surrounds the modules, and the examples are not limiting.

Having described the elements of the sports training assembly, an exemplary method of assembling the sports training assembly is described below. The first module 4 can be positioned on a surface such as the ground, and the second module 6 positioned at a non-parallel angle to the first module 4. A protrusion 22 on the second module 6 can be aligned with a receiver 26 on the first module 4. The module 6 with the protrusion 22 can be rotated to an angle to match the angle $\alpha$ of the receiver 26 relative to the datum plane 34, illustrated in FIG. 5. The protrusion 22 on the second module 6 will generally be rotated at an angle relative to the module 4, although it is understood that the first module 4 can be rotated to match the alignment of the protrusion on the module 6, or both modules can be rotated to align the receiver and the protrusion. Thus, at the time of insertion of the protrusion 22 with the receiver 26, the top surfaces 10 of the modules 4 and 6 are not aligned, because one module is rotated at an angle relative to the other module. The protrusion 22 on the module 6 can be inserted into the receiver 26 until the end 16 of the second module 6 abuts the side 14 of the first module 4. The second module 6 can be rotated with a twist, such as in the opposite direction that it was rotated earlier for the insertion, to couple the wings 40, 42 behind the interior surfaces of the wall of module adjacent the receiver 26. The rotation of the second module 6 relative to the module 4 can terminate when the top surface 10 of the second module 6 is aligned with the top surface 10 of the first module 4. In embodiments having protrusion tabs 33 in the receivers, the module is positively restricted from further rotation when the wings 40, 42 engage the protrusion tabs.

The length of the sports training assembly 2 can be increased by coupling the third module 8 to the second module 6. In a similar fashion as described above, the module 8 can be rotated at an angle $\alpha$ to align its protrusion 22 with the corresponding receiver 24 on the end 18 of the second module 6. The protrusion 22 can be inserted in the receiver 24, and the module 8 rotated relative to the second module 6 to couple the protrusion 22 in the receiver 24 and align the top surface 10 of the third module 8 with the top surface 10 of the second module 6.

In the exemplary embodiment, with the above exemplary dimensions, the assembly forms a length of about 36 inches along the first module 4 and a cumulative length of about 78 inches that includes the width of the first module and length of the second and third modules. It is believed that such lengths are suitable for most stances of batters and other sports persons that vary their strides from one position to another during a sports training activity.

If not already positioned, the various modules can be placed on the ground or other suitable supporting surface. A person, such as a batter, can stand on the top 10 of the modules to conduct a sports training activity. When assembled, the sports training assembly lies flat on the ground and in at least one exemplary use, a batter will stand in the position of a hitter in the "batter's box" with the batter's back foot (that is, the foot farthest from the pitcher's mound and oncoming ball) standing on the top 10 of the module 4. The batter's front foot (that is, the foot closest to and in the general direction of the pitcher) will stand on the top surface 10 of the second module 6, the third module 8, or both. Generally, the back foot can be aligned in the longitudinal direction of the first module 4 and the front foot can be positioned transverse to the longitudinal direction of the second module 6 and the third module 8.

As the ball approaches the batter, and the batter takes a step and increases his stride, the back foot will generally stay positioned on the top surface 10 of the first module 4, while the front foot will step along the length of the top surfaces 10 of the modules 6, 8 to a full stride position. The batter will know in real time whether the front foot has stepped inappropriately outside or inside relative to the trajectory of the ball if the foot leaves the width of the top 10 of the modules 6, 8.

Upon completion of the sports training activities, the modules can be disassembled, stacked together, and transported to a vehicle or other storage place for the next time a sports training activity occurs.

Various accessories can be used with the sports training assembly 2. For example, in training baseball players to pitch from a pitchers' mound, the sports training assembly 2 can approximate the general distance by which a center of a pitcher's mound is higher than the peripheral edge of the pitcher's mound. When a pitcher pitches, the pitcher's back foot will be at the highest point of the pitcher's mound. As the pitcher steps forward during the pitch toward the home plate and batter, the front foot steps down the slope of the pitcher's mound, resulting in an elevation of the front foot that is several inches lower than the back foot. In practice, it is rare to offer a pitcher's mound to several pitchers concurrently, because access to multiple pitcher's mounds at most practice fields at the same time is difficult. The present invention can also provide a pitching accessory illustrated in FIG. 12 and described below.

Figure 12:
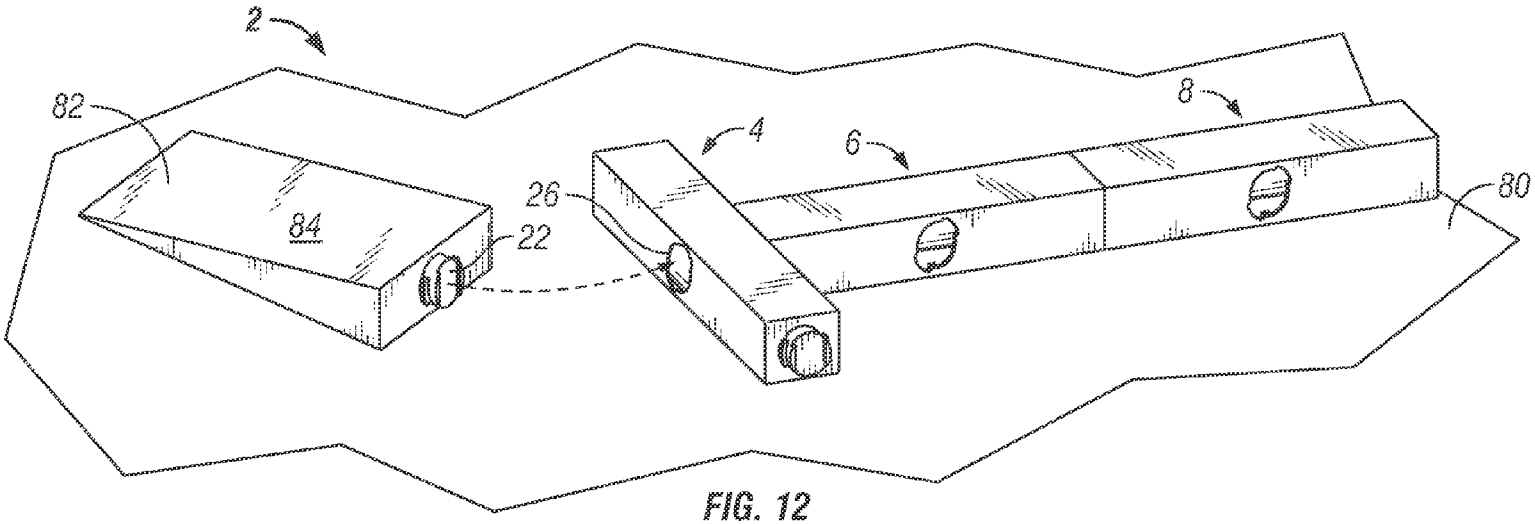
FIG. 12 is a perspective schematic view of an exemplary embodiment of a modular sports training assembly with a pitching accessory.

FIG. 12 is a perspective schematic view of an exemplary embodiment of a modular sports training assembly with a pitching accessory. The pitching accessory 82 generally includes a sloped surface 84 that on one end is coupled to one or more of the modules 4, 6, 8, described above, of the sports training assembly 2 and on the other end is generally supported by the ground 80. The length of the sloped surface 84 can be about 36 inches, although other lengths can be used. The sloped surface 84 can simulate the approximate drop of a typical pitcher's mound and provide more realistic training for a pitcher when the pitcher pitches from a pitcher's mound. The pitching accessory 82 can further include a protrusion 22 as described above that can be used to couple the pitching accessory to the one or more modules 4, 6, 8 in the receiver 26, as described above for coupling the modules together. The ease of movement of the sports training assembly 2 and the pitching accessory 82 can allow coaches and players to have simulated pitching mounds at a wider variety of locations and improve the ability of multiple pitchers to train by pitching concurrently from multiple sports training assemblies and pitching accessories. In general, a vacant strip of land that is approximately 60 feet long by 5 feet wide can provide sufficient room for each pitcher to train using the sports training device 2 with the pitching accessory 82.

Other and further embodiments utilizing one or more aspects of the inventions described above can be devised without departing from the spirit of the invention. For example, various sizes and shapes of the modules can be used. The protrusions can be formed on one or more sides and receivers on ends. Various sizes and shapes of the protrusion and receivers can be used. The modules can be assembled in different manners. The modules can be transported in various ways with or without the illustrated strap. Other variations in the system are possible.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation, integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A sports training assembly for training persons for sports activities, comprising:

a first component comprising:

a formed structure having an interior cavity and further including at least:

a flat top surface, first and second end surfaces each formed at a non-parallel angle to the flat top surface, and a first opposing side surface and a second opposing side surface, the first and second opposing side surfaces extending between the first and second end surfaces;

a first protrusion formed from the first end surface, integral with and extending outwardly away from the first end surface;

a first receiver formed in the second end surface;

a second receiver formed in the first opposing side surface; and at least one internal cross support member formed within the interior cavity, the at least one internal cross support member spanning a distance from the first opposing side surface to the second opposing side surface and comprising planar support surfaces, the flat top surface of the first component accommodating and supporting a person thereon during a sports training activity, the person when standing or repositioning thereon during the sports training activity having at least one foot on the flat top surface during at least a portion of the sports training activity, the flat top surface being elevated above a supporting surface on which the assembly is positioned, such that the at least one foot is entirely elevated above the supporting surface and is accommodated and supported on the flat top surface during at least a portion of the sports training activity; and a second component interchangeable with the first component, the second component comprising:

a formed structure having an interior cavity and further including at least:

a flat bottom surface, first and second end surfaces formed at a non-parallel angle to the flat bottom surface, and a first opposing side surface and a second opposing side surface, the first and second opposing side surfaces extending between the first and second end surfaces;

a second protrusion formed at the first end surface of the second component, the second protrusion integral with and extending outwardly away from the first end surface of the second component;

a third receiver formed in the second end surface of the second component;

a fourth receiver formed in the first opposing side surface of the second component; and at least one internal cross support member formed within the interior cavity of the second component, the at least one internal cross support member spanning a distance from the first opposing side surface to the second opposing side surface of the second component and comprising planar support surfaces, the second component is configured to couple in a mating relationship with the first component to form the assembly, such that when mating, the first protrusion of the first component is compatible with and is physically adjacent the second protrusion of the second component so that the flat top surface of the first component and the flat bottom surface of the second component form opposing outer surfaces of the sports training assembly, and the flat top surface of the first component when in the mating relationship being elevated above the supporting surface on which the assembly is positioned.

2. The sports training assembly of claim 1, further comprising at least a third component interchangeable with one of the first component and the second component, such that the third component is configured to couple to the first end surface or the second end surface of at least one of the first component and the second component, and upon coupling, the third component extends a length of sports training assembly in one direction.

3. The sports training assembly of claim 1, wherein a length of the first and second components when coupled is about thirty six inches long.

4. The sports training assembly of claim 1, wherein a width of the top surface of the first component is at least four inches.

5. The sports training assembly of claim 1, wherein the first opposing side surface and the second opposing side surface of at least one of the first component and the second component have one or more receivers formed therein.

6. The sports training assembly of claim 1, wherein the second receiver formed in the first opposing side surface of at least one of the first component and the second component is formed in a mid-portion of the first opposing side surface.

7. The sports training assembly of claim 1, wherein the second protrusion of the second component is adapted to be secured in a receiver of at least a third component.

8. The sports training assembly of claim 1, wherein at least one of the first and second protrusion comprises:

a main portion extending longitudinally away from the first end surface; and first and second opposing individual wings, each extending radially away from an exterior surface of the main portion, and the first and second opposing individual wings on the main portion are so positioned so as to be inserted into any one of the one or more receivers in a first orientation and unable to be inserted into any one of the one or more receivers in a second and different orientation with respect to a horizontal plane passing through a center of into any one of the one or more receivers.

9. The sports training assembly of claim 1, further comprising an accessory coupled to the second opposing side surfaces of the coupled first and second components, the accessory having a sloped surface in a direction leading away from the second opposing side surfaces of the coupled first and second components.

10. The sports training assembly of claim 1, wherein in the mating relationship, the flat bottom surface of the second component and the flat top surface of the first component are interchangeable to allow the person to stand or reposition thereon during the sports training activity.

11. The sports training assembly of claim 1, wherein the first component and the second component have a same size and shape.

12. The sports training assembly of claim 1, wherein at least one of the first component and the second component have receivers on both the first and the second opposing side surfaces.

13. The sports training assembly of claim 1, wherein the at least one internal cross support member in at least one of the first component and the second component includes a recessed portion to accommodate an accessory stored within the interior space of the sports training assembly.

14. The sports training assembly of claim 1, wherein the sports training assembly accommodates and supports both feet of the person standing or repositioning thereon during at least a portion of the sports training activity.

15. A method of assembling a sports training assembly for training persons for sports activities, the method comprising:

obtaining a first component, the first component comprising:

a formed structure having an interior cavity and further including at least a flat top surface, first and second end surfaces each formed at a non-parallel angle to the flat top surface, a first opposing side surface and a second opposing side surface, the first and second opposing side surfaces extending between the first and second end surfaces;

a first protrusion formed from the first end surface, integral with and extending outwardly away from the first end surface;

a first receiver formed in the second end surface;

a second receiver formed in the first opposing side surface; and at least one cross support member formed within the interior cavity spanning a distance from the first opposing side surface to the second opposing side surface and comprising planar support surfaces, obtaining a second component interchangeable with the first component, the second component comprising;

a formed structure having an interior cavity and further including at least a flat bottom surface, first and second end surfaces formed at a non-parallel angle to the flat bottom surface, and a first opposing side surface and a second opposing side surface, the first and second opposing side surfaces extending between the first and second end surfaces;

a second protrusion formed at the first end surface of the second component, the second protrusion integral with and extending outwardly away from the first end surface of the second component;

a third receiver formed in the second end surface of the second component;

a fourth receiver formed at the first opposing side surface of the second component; and at least one cross support member formed within the interior cavity spanning a distance from the first opposing side surface to the second opposing side surface of the second component and comprising planar support surfaces; and coupling the first component with the second component such that, upon coupling, the first protrusion of the first component and the second protrusion of the second component form a functional mating relationship in which said first protrusion is compatible with and is physically adjacent the second component, upon coupling, the flat top surface of the first component and the flat bottom surface of the second component form opposing outer surfaces of the sports training assembly, the flat top surface to accommodate and support a person during a sports training activity, the person when standing or repositioning thereon during the sports training activity having at least one foot on the flat top surface during at least a portion of the sports training activity, thereby elevating the at least one foot above a supporting surface on which the assembly is positioned, so that the at least one foot of the person standing or repositioning on the top surface is supported on said flat top surface during the at least a portion of the sports training activity.

16. The method of claim 15, further comprising coupling a third component to either the first or second components to extend a length of the sports training assembly.

17. The method of claim 15 the further comprising providing a third component, structurally compatible with one of the first component and second components, and wherein coupling with the third component one of the first component and second components comprises:

inserting the protrusion from the one of the first and second components into a separate receiver of the third component when the protrusion is at a rotated angle relative to the third component such that a flat top surface of the third component is in a non-aligned relationship with respect to the flat top surface of the one of the first and second components; and twisting rotationally the one of the first and second components relative to the third component to align flat top surfaces and to restrain the protrusion in the separate receiver of the third component.

18. The method of claim 15, further comprising placing the coupled first and second components on a ground surface.

19. The method of claim 15, further comprising coupling a pitching accessory to the coupled first and second components.

20. A sports training assembly for training persons for sports activities comprising:

at least a first compatible module and a second compatible module, each compatible module as a formed structure having at least:

a wall with an exterior surface and an interior space, the wall further including:

a flat top surface to accommodate and support a person standing or repositioning on said flat top surface during a sports training activity;

a first end surface formed at a non-parallel angle to the flat top surface;

a second end surface opposing the first end surface;

a first opposing side surface and a second opposing side surface, each in a planar orientation with respect to each other, the first and second opposing side surfaces extending between the first and second end surfaces;

a first protrusion integral with the first end surface and extending outwardly away from the first end surface forming an extended surface, the first protrusion containing at least one discrete individual wing spaced apart on the extended surface, the at least one discrete individual wing projecting radially outward from the extended surface;

a first receiving region formed through the wall of the first opposing side surface forming a direct passage into the interior space, the first receiving region having a shape to allow one other protrusion containing at least one discrete individual wing from one other compatible module to be inserted therein and to be restrained, the first receiving region further comprising at least one tab region formed through the wall for accepting the at least one discrete individual wing of the one other protrusion of the one other compatible module; and a second receiving region formed through the wall of the second end surface forming a direct passage into the interior space, the second receiving region having a shape and size that is generally of the same shape and size as the first receiving region; and at least one cross support member formed within the interior space spanning a distance from the first opposing side surface to the second opposing side surface, such that the at least one discrete individual wing of the at least first protrusion on the first compatible module engages and secures with either the first receiving region or the second receiving region of the second compatible module to form the assembly, in which secure engagement of the at least the first compatible module and the second compatible module includes receipt of the at least one discrete individual wing of the first protrusion of the first compatible module in the first receiving region or the second receiving region of the second compatible module to respectively secure the first protrusion of the first compatible module with the second module by securing into the first receiving region or the second receiving region of the second compatible module, such that the first protrusion and the at least one discrete individual wing of the first compatible module extends through the respective receiving region and into the interior space of the second compatible module, with secure engagement, the assembly is restrained on a supporting surface on which the assembly is positioned so the person conducting the sports training activity thereon stands on a top formed by the flat top surfaces of the at least the first compatible module and the second compatible module during at least a portion of the sports training activity, and a foot of the person standing or repositioning on said top is accommodated and supported on said top during at least a portion of the sports training activity, and with secure engagement, the foot of the person standing or repositioning on the top is elevated above the supporting surface during at least a portion of the sports training activity, the elevation provided by at least the first end surface, the second end surface, the first and second opposing side surfaces, and the at least one cross support member of the at least the first compatible module and the second compatible module.

21. The sports training assembly of claim 20, wherein the first compatible module with the first protrusion is further adapted to be coupled with the second or third receiver of the second compatible module, the first protrusion to be inserted into the second or third receiver at a rotated angle such that the flat top surface of the first compatible module and the flat top surface of the second compatible module are non-aligned, and upon a rotational twist of at least one of the first and second compatible modules relative to each other, the flat top surface of the first compatible module and the flat bottom surface of the second compatible module-become aligned, such that when the first protrusion is inserted into the second receiver and upon the rotational twist, the first compatible module and the second compatible module are in a perpendicular relationship with one another, and when the first protrusion is inserted into the third receiver and upon the rotational twist, the first compatible module and the second compatible module are in series.

22. The sports training assembly of claim 20, wherein the at least one discrete individual wing includes spaced apart first and second opposing wings.

23. The sports training assembly of claim 20, wherein the at least one discrete individual wing has an edge thickness less than a thickness in a mid-portion.

24. The sports training assembly of claim 20, wherein the at least one tab region includes spaced apart first and second opposing tabs.

25. The sports training assembly of claim 20, wherein the at least the first compatible module and the second compatible module have a same shape, size and configuration.

26. The sports training assembly of claim 20, wherein the at least the first compatible module and the second compatible module are coupled so the flat top surfaces of the at least the first compatible module and the second compatible module are in a perpendicular arrangement in the restrained position.

27. The sports training assembly of claim 20, wherein secure engagement of the at least the first compatible module and the second compatible module provides corresponding flat top surfaces on a same plane.

28. The sports training assembly of claim 20, wherein the at least the first compatible module and the second compatible module are so coupled that the flat top surfaces of the at least the first compatible module and the second compatible module are arranged in series.

29. The sports training assembly of claim 20, wherein the at least one cross support member comprises a recessed portion to accommodate an accessory stored within the interior space of the sports training assembly.

30. A sports training assembly for training persons for sports activities comprising:

a compatible module as a formed structure having at least:

a wall with an exterior surface and an interior space, the wall comprising:

a flat top to accommodate and support a person standing or repositioning on said flat top during a sports training activity;

a first end surface formed at a non-parallel angle to the flat top;

a second end surface opposing the first end surface;

a first opposing side surface and a second opposing side surface, each in a planar orientation with respect to each other, each end of the first opposing side surface forming a corner with a respective end of the first and second end surfaces, each end of the second opposing side surface forming opposing corners with a respective end of the first and second end surfaces;

a protrusion integral with the first end surface and extending outwardly away from the first end surface forming an extended surface;

at least one cross support member formed within the interior space spanning a distance from the first opposing side surface to the second opposing side surface that further supports the person when standing or repositioning on the flat top during the sports training activity, the at least one cross support member further comprising a recessed portion and a planar support surface, a first receiver formed in the second end surface;

a second receiver formed in the first opposing side surface; and a third receiver formed in the second opposing side surface, the sports training assembly configured to be restrained on a supporting surface on which the assembly is positioned, to accommodate and support a foot of the person standing or repositioning on the flat top of the compatible module during at least a portion of the sports training activity, and the flat top elevating the foot of the person above the supporting surface during at least a portion of the sports training activity so that the foot is accommodated and supported on said flat top during at least a portion of the sports training activity.

31. The sports training assembly of claim 30, wherein the protrusion includes a main portion that extends longitudinally away from the first end surface and first and second opposing individual wings, each individual wing extending radially away from an exterior surface of the main portion, and the first and second opposing individual wings on the main portion are so positioned so as to be inserted into a separate receiver provided on a separate compatible module so as to extend into an interior cavity of the separate compatible module.

32. The sports training assembly of claim 30, wherein the compatible module is a first compatible module coupled with a second compatible module in a perpendicular arrangement.

* * * * *